US009347291B2

(12) United States Patent
Reimert et al.

(10) Patent No.: US 9,347,291 B2
(45) **Date of Patent: *May 24, 2016**

(54) WELLHEAD SEAL ASSEMBLY LOCKDOWN SYSTEM

(75) Inventors: Larry E. Reimert, Houston, TX (US); Daniel A. Marroquin, Houston, TX (US); Flavio Nisenbaum, Rio de Janeiro (BR); Denise A. M. Antunes, legal representative, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 414 days.

This patent is subject to a terminal disclaimer.

(21) Appl. No.: 13/635,072

(22) PCT Filed: Jul. 8, 2011
(Under 37 CFR 1.47)

(86) PCT No.: PCT/US2011/043293

§ 371 (c)(1),
(2), (4) Date: Jun. 21, 2013

(87) PCT Pub. No.: WO2012/060909

PCT Pub. Date: May 10, 2012

(65) Prior Publication Data

US 2014/0251630 A1 Sep. 11, 2014

Related U.S. Application Data

(60) Provisional application No. 61/408,755, filed on Nov. 1, 2010.

(51) Int. Cl.
*E21B 33/035* (2006.01)
*E21B 33/043* (2006.01)
*E21B 33/14* (2006.01)
*E21B 33/00* (2006.01)

(52) U.S. Cl.
CPC ..... *E21B 33/143* (2013.01); *E21B 33/043* (2013.01); *E21B 2033/005* (2013.01)

(58) Field of Classification Search
CPC .... E21B 33/035; E21B 33/043; E21B 33/143
USPC ..... 166/338, 348, 360, 368; 277/323
See application file for complete search history.

(56) References Cited

U.S. PATENT DOCUMENTS

| | | | | | |
|---|---|---|---|---|---|
| 3,472,530 | A | * | 10/1969 | Fowler | 285/3 |
| 3,489,213 | A | * | 1/1970 | Hutchison | 166/348 |
| 3,548,934 | A | * | 12/1970 | Hutchison | 166/368 |
| 4,757,860 | A | * | 7/1988 | Reimert | 166/208 |
| 5,076,356 | A | * | 12/1991 | Reimert | 166/115 |
| 5,174,376 | A | * | 12/1992 | Singeetham | 166/208 |
| 5,287,925 | A | | 2/1994 | Watkins et al. | |
| 6,598,680 | B2 | | 7/2003 | DeBerry | |
| 6,705,615 | B2 | | 3/2004 | Milberger et al. | |

(Continued)

*Primary Examiner* — Matthew R Buck
(74) *Attorney, Agent, or Firm* — Baker Botts L.L.P.

(57) ABSTRACT

A seal assembly (30) and a running tool (20) are provided for sealing a casing annulus in a wellhead (14). A casing hanger (12) includes a radially external groove therein, and wellhead has a radially internal groove therein. A locking ring (36) may be actuated by the running tool to move into the internal recess in the wellhead and thereby axially connect the seal assembly and the wellhead. Another locking ring (40) is radially movable to connect the seal assembly to the casing hanger. The seal assembly seals the casing annulus while being interconnected with the wellhead and the casing hanger.

19 Claims, 11 Drawing Sheets

(56) References Cited

U.S. PATENT DOCUMENTS 6,969,070 B2 * 11/2005 Reimert et al. ..... 277/323
7,096,956 B2 * 8/2006 Reimert ..... 166/348
2010/0193195 A1 * 8/2010 Nguyen et al. ..... 166/338
2013/0206427 A1 * 8/2013 Reimert et al. ..... 166/387

* cited by examiner

WELLHEAD SEAL ASSEMBLY LOCKDOWN SYSTEM

CROSS REFERENCE TO RELATED APPLICATIONS

This application is a U.S. national stage application of PCT Appln. No. PCT/US11/43293 filed on Jul. 8, 2011, which claims the priority of U.S. Provisional Application No. 61/408,755 filed on Nov. 1, 2010, the disclosure of which is incorporated herein by reference for all purposes.

FIELD OF THE INVENTION

A seal assembly and running tool are provided for sealing a casing annulus in a wellhead. More particularly, the seal assembly is axially interconnected with the wellhead while sealing an annulus between the casing hanger and the wellhead.

BACKGROUND OF THE INVENTION

Various types of seal assemblies and running tools have been devised for sealing a casing annulus. A casing hanger may be positioned within the wellhead, and a running tool may be used to actuate the seal assembly carried on the casing hanger and thereby seal with the casing hanger.

For various reasons, a casing hanger within the wellhead may move axially upward, particularly when the wellhead is part of a production system wherein downhole fluids at elevated temperatures thermally expand the casing string and thus exert a substantial upward force on the casing hanger. Since the casing hanger seal is intended for sealing at a particular location on the wellhead, upward movement of the casing hanger and the seal assembly is detrimental to reliably sealing the casing annulus.

A seal assembly for a casing hanger in a wellhead is disclosed in U.S. Pat. No. 5,287,925. Another type of seal assembly between a wellhead and a tubing hanger seal is disclosed in U.S. Pat. No. 6,598,680. U.S. Pat. No. 6,705,615 discloses yet another version of a seal assembly for use in a wellhead, and U.S. Pat. No. 6,969,070 discloses improvements in a seal assembly. A pressure actuated seal assembly and running tool are disclosed in U.S. Pat. No. 7,096,956.

The disadvantages of the prior art are overcome by the present invention, an improved wellhead seal assembly and running tool are hereinafter disclosed.

SUMMARY OF THE INVENTION

In one embodiment, a seal assembly is provided for sealing a casing annulus in a wellhead. A casing hanger is positioned within the wellhead, which is provided with a radially internal groove. A first locking ring is radially movable into the internal groove in the wellhead to axially connect the seal assembly and the wellhead. A second locking ring may interconnect the seal assembly and the casing hanger. Actuating a running tool radially moves each locking ring into the groove in the respective wellhead and the hanger, and thereby axially connects the seal assembly to both the wellhead and the hanger.

These and further features and advantages of the present invention will become apparent from the following detailed description, wherein reference is made to the figures in the accompanying drawings.

DETAILED DESCRIPTION OF PREFERRED EMBODIMENTS

Figure 1:
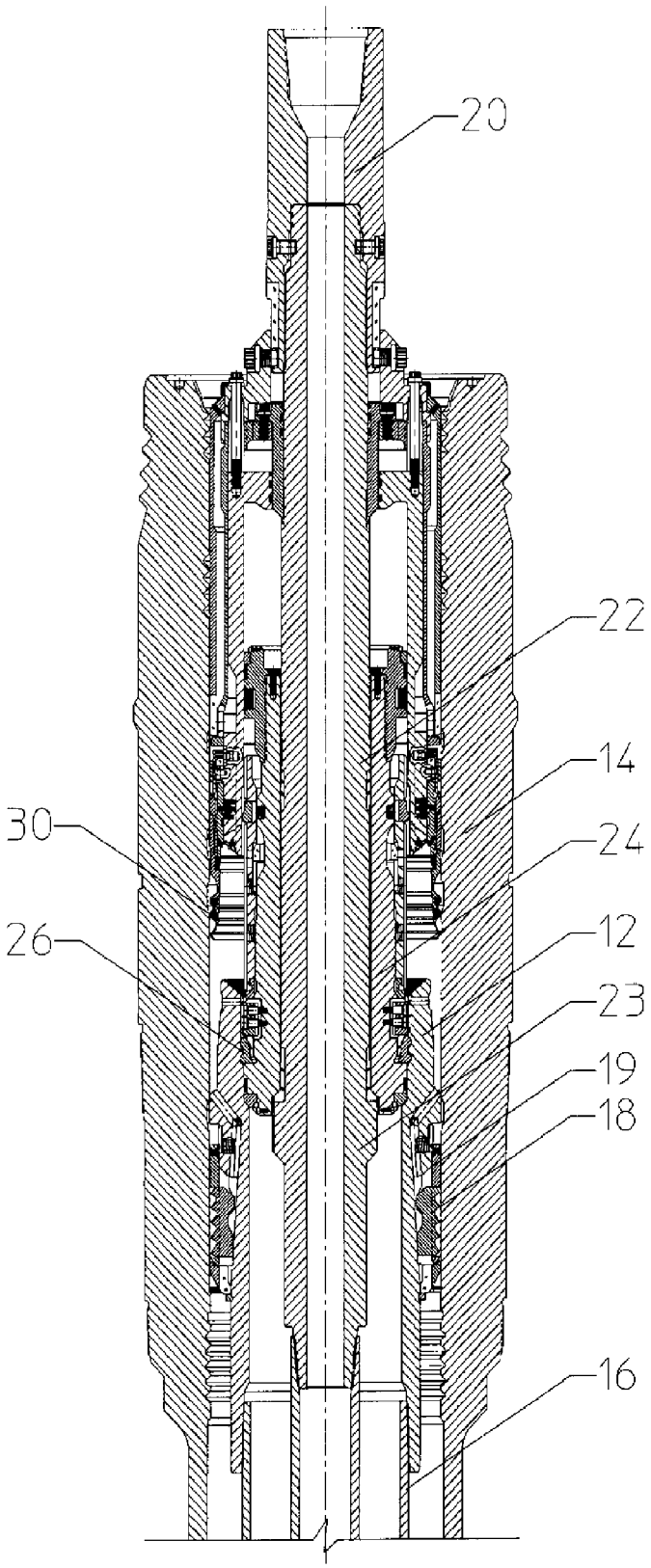
FIG. 1 is a cross-sectional view of a running tool and seal assembly prior to landing the casing hanger in the wellhead.

FIG. 1 depicts a suitable running tool 20 supporting a casing hanger 12 being lowered into a subsea wellhead 14. The running tool 20 includes a central mandrel 22 having a lower enlarged portion 23. Sleeve 24 of the running tool is locked to the casing hanger by the C-ring 26. The casing hanger is subsequently locked to the wellhead with one or more C-rings 18, and supports casing 16 extending downward into the well. In one embodiment, the running tool carries the seal assembly and the casing hanger into the well, while in other embodiments the casing hanger is already landed on the wellhead, and the running tool is lowered to form the seal as discussed subsequently.

Figure 2:
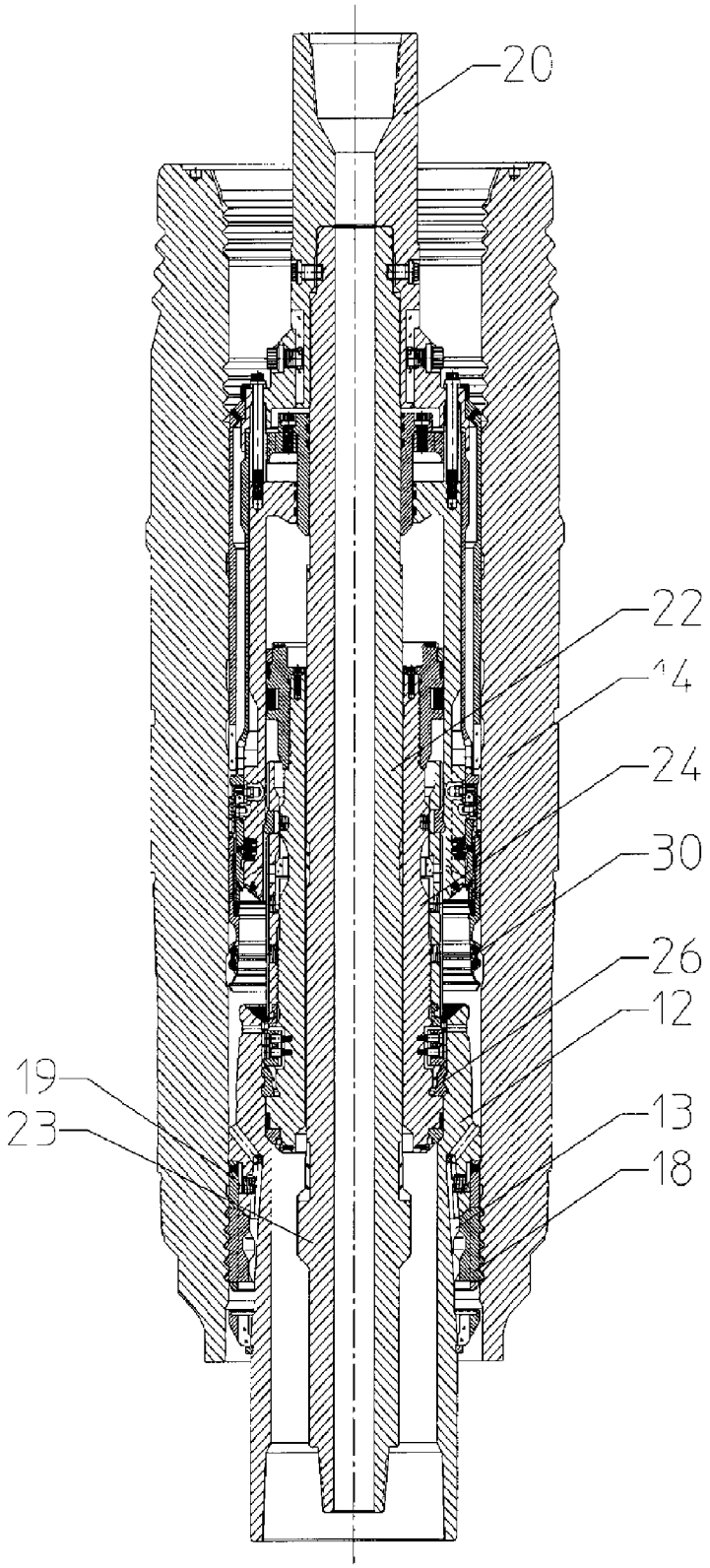
FIG. 2 is a cross-sectional view of the assembly shown in FIG. 1 with the casing hanger landed in the wellhead.

FIG. 2 depicts the casing hanger 12 landed in the wellhead 14 and locked by C-ring 18. Sleeve 24 is supported on the shoulder in the casing hanger 12, and the seal 30 is positioned above the top of the casing hanger. Note that enlarged portion 23 of mandrel 22 has moved downward relative to the FIG. 1 position. Running tool set down weight applied by the casing hanger 12 actuates releasing sleeve 19, which releases C-ring 18. Further downward movement of hanger 12 causes radial protrusions 13 on the hanger to force C-ring 18 into the mating grooves in the wellhead 14. At this stage, the running tool 20 remains latched to the casing hanger 12 by C-ring 26.

Figure 3:
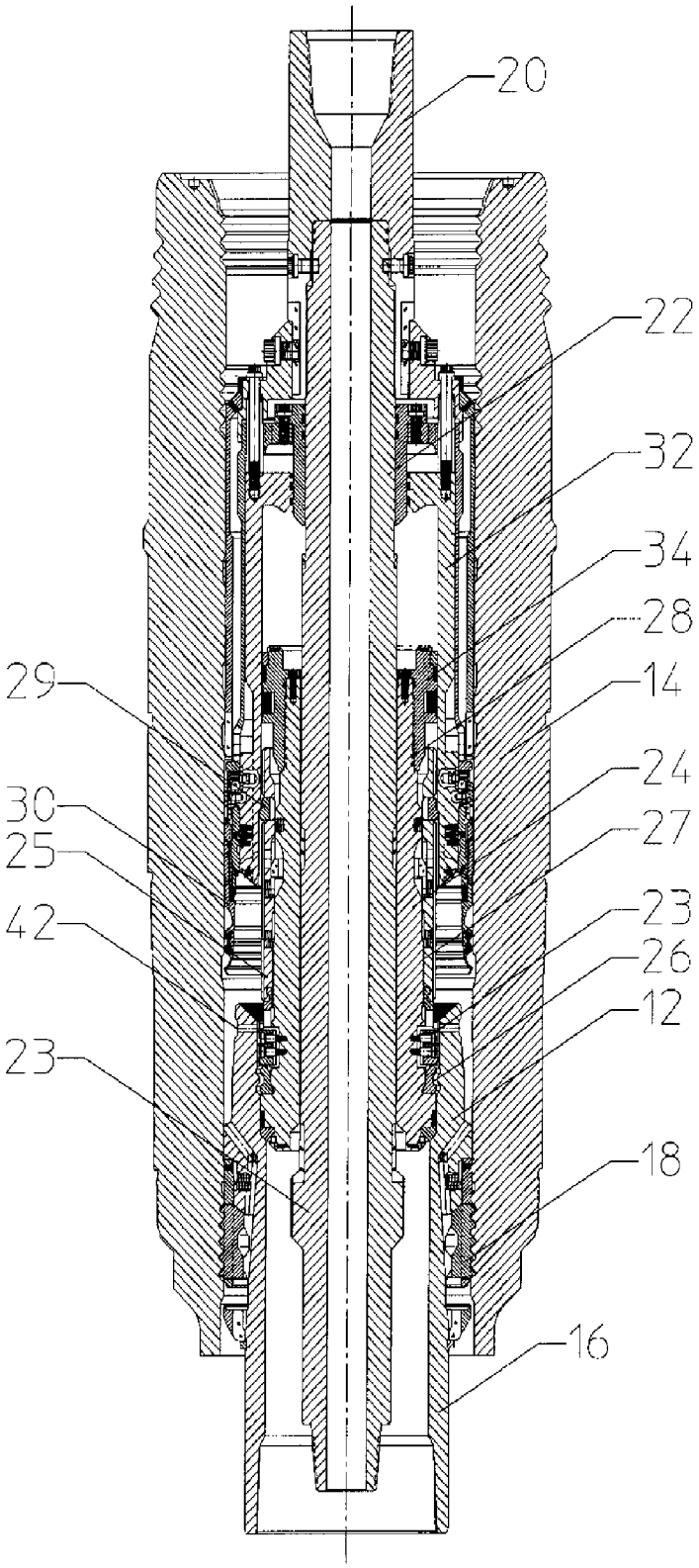
FIG. 3 is a cross-sectional view of the assembly shown in FIG. 2 in a preset position before the seal is finally set.

Referring now to FIG. 3, the running tool 20 may be rotated by the work string to release the running tool from the hanger 12, thereby raising the enlarged portion 23 slightly. Sleeve 24 remains axially fixed to the hanger 12 by locking ring 26. Sleeve 25 radially outward of sleeve 24 slides with the mandrel 22 such that threads 27 cause sleeve 25 to move axially upward, which allows the C-ring 26 to radially collapse. Rotating the running tool thus raises the sleeve 25 to allow the C-ring 26 to collapse. The C-ring 26 moves radially inward and out of engagement with the internal locking grooves on the casing hanger. The hanger is now released from the running tool.

As shown in FIG. 3, C-ring 29 is positioned to axially connect sleeves 25 and 32. Sleeve 32 is sealed to ring 34, which is threaded to an upper end of sleeve 24. The seal assembly 30 is thus in its preset position in FIG. 3 while FIG. 5 shows the seal assembly 30 in the set position.

Figure 4:
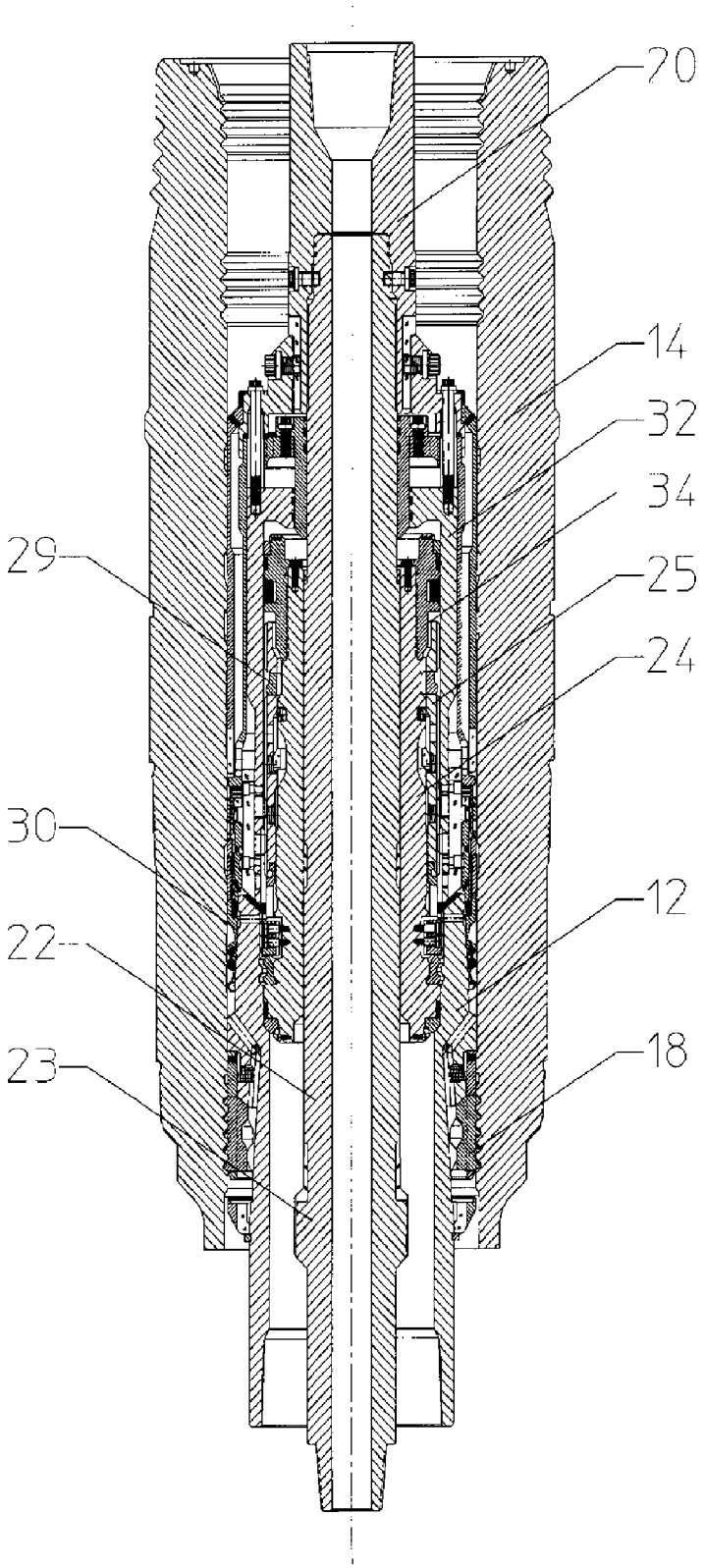
FIG. 4 is a cross-sectional view of the assembly shown in FIG. 3 with the running tool released from the casing hanger.

Referring now to FIG. 4, the running tool 20 is further rotated to move sleeve 25 further upward, thereby allowing dogs 29 to collapse, and allowing sleeve 32 and seal 30 to drop into the preset position. The seal 30 and the running tool mandrel 22 may move down independently, with the seal assembly 30 in the annulus between the upper enlarged OD of the hanger 12 and the ID of the wellhead 14. At this stage, the BOP conventionally positioned on top of the wellhead may be closed, and fluid pressure exerted to drive the seal assembly 30 further downward from its preset position to its final sealing position.

Figure 5:
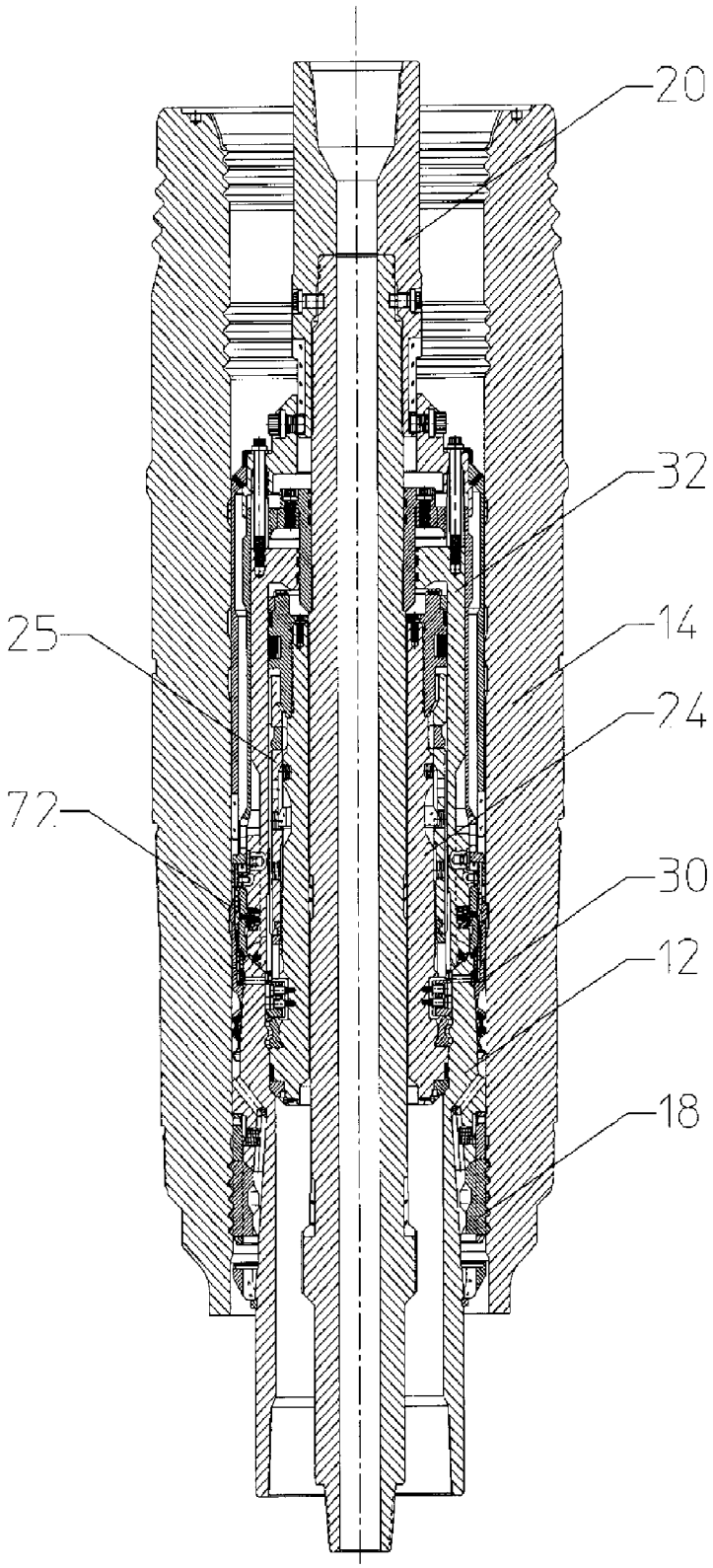
FIG. 5 is a cross-sectional view of the assembly shown in FIG. 4 with the seal assembly set, locked, and tested.

In FIG. 5, the seal 30 has been set and locked to the casing hanger 12. The shear pins holding the running tool to the seal may now be sheared so that the running tool is released from the seal assembly and may be retrieved to the surface.

Figure 6:
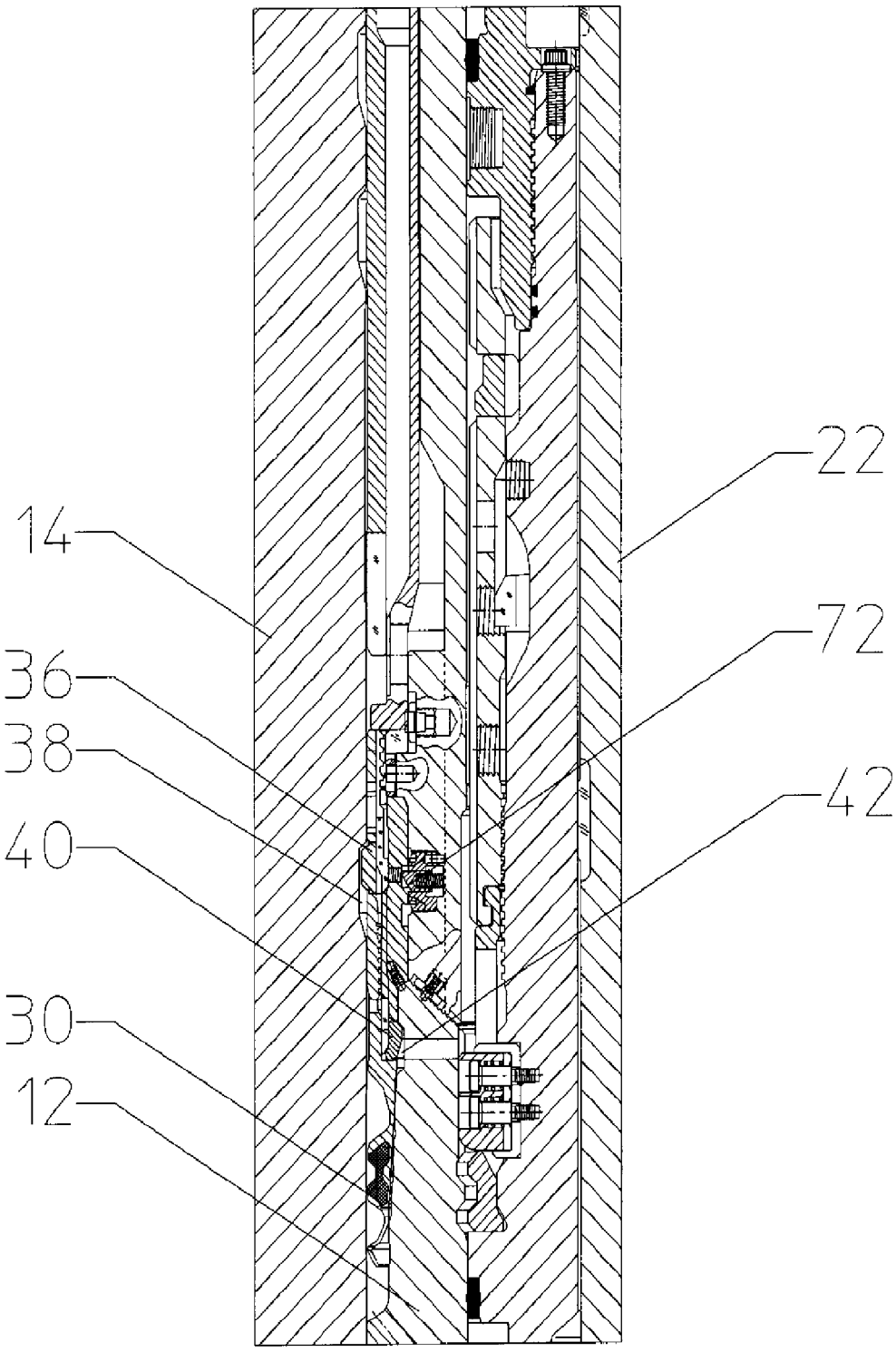
FIG. 6 is an enlarged view of a portion of the assembly shown in FIG. 5.

FIG. 6 is an exploded view of a portion of the apparatus shown in FIG. 5, and illustrates the seal assembly 30 axially fixed to both the wellhead 14 and casing hanger 12 by the rings 36 and 40, respectively. Ring 36 fits within wellhead groove 38, while ring 40 fits in casing hanger groove 42.

Figure 7:
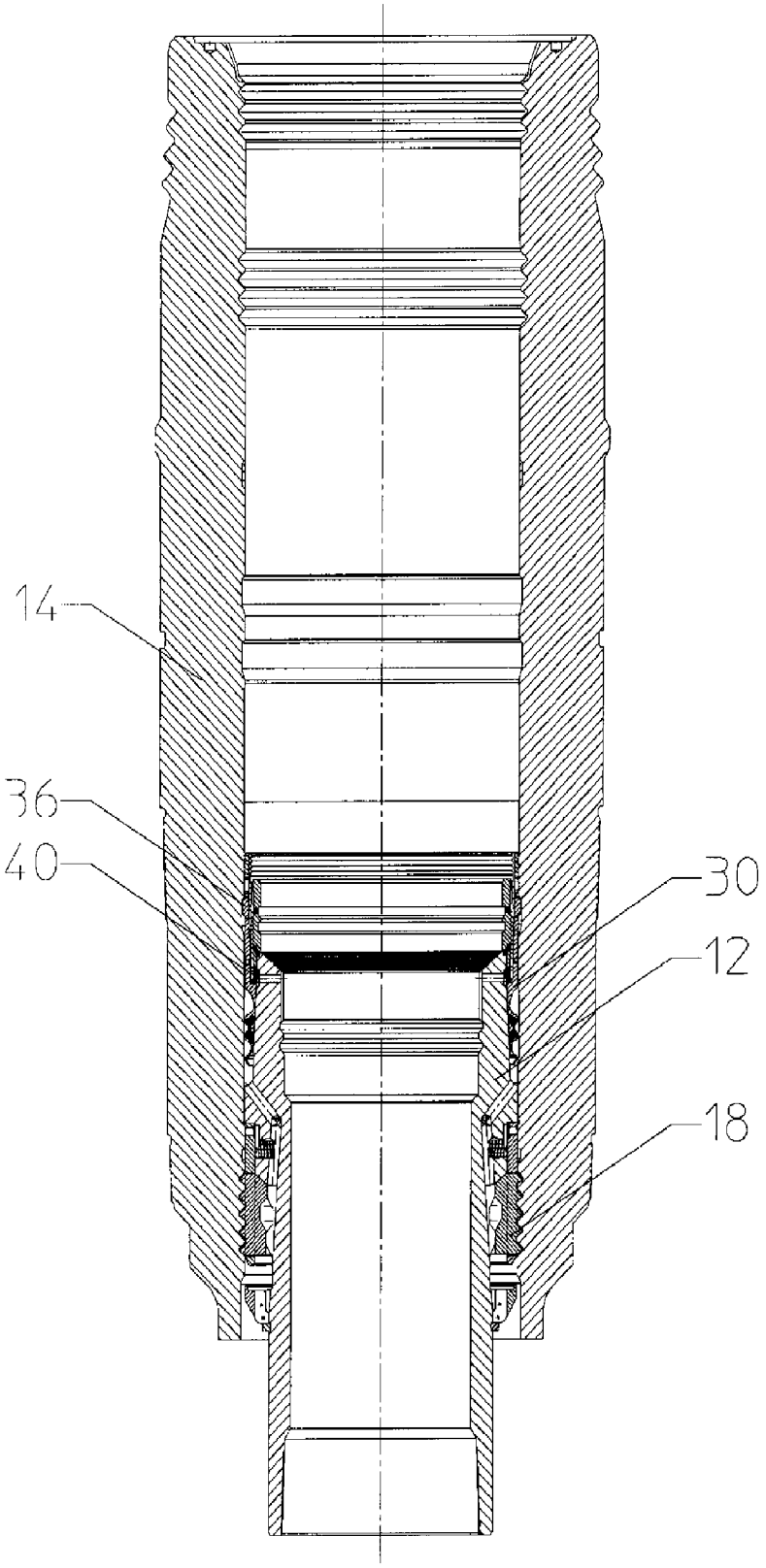
FIG. 7 is cross-sectional view of the downhole assembly with the running tool retrieved.

FIG. 7 illustrates the running tool removed from the wellhead with the casing hanger 12 and the seal assembly 30 in place. Casing hanger 12 remains landed in the wellhead, and seal assembly 30 reliably seals between the casing hanger and the wellhead. Locking rings 36 and 40 axially fix the seal assembly in place on the wellhead and the casing hanger.

Figure 8:
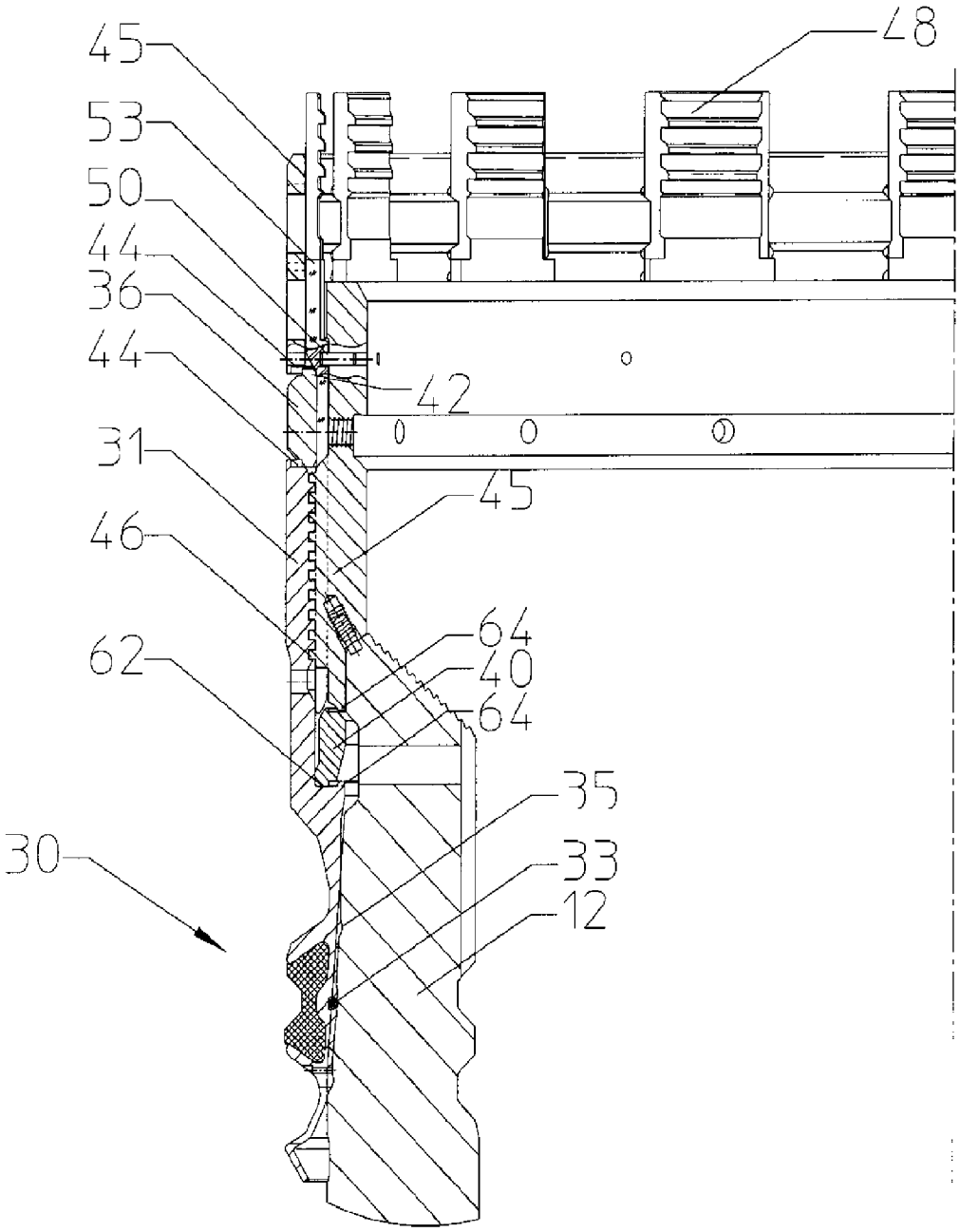
FIG. 8 is an enlarged view of a portion of the assembly shown in FIG. 7.

FIG. 8 shows in greater detail a portion of the seal assembly. The seal assembly 30 is provided with a sleeve shaped extension 31, which carries a C-shaped latch ring 36 for interconnection with the wellhead, and a similar locking ring 40 for interconnection with casing hanger 12. Threads 46 between the sleeve extension body 31 and main seal body 45 facilitate manufacture and assembly. Grooves 48 in the upwardly projecting fingers 53 are provided for retrieving the seal assembly. Sufficient upward pull on fingers 53 releases the C-rings 36 and 40, which move radially to release the seal assembly from the wellhead and casing hanger, respectively. Shear pin 50 prevents premature downward movement of the fingers 53 with respect to supporting body 45.

A feature of the invention is that each of the latch ring 36 and the connecting ring 40 is radially contained by the seal body. Ring 36 is radially contained at its lower end by seal body extension 31 and at its upper end by seal body 45 so that the ring 36 cannot inadvertently come out of its retained position, i.e., no circumferential portion of ring 36 can extend completely outside the seal body due to the stops 44 on the seal body 45 and the body extension sleeve 31. More particularly, the latch ring 36 includes upper and lower protrusions 42 which engage corresponding upper and lower stops 44 on the extension sleeve 31 and body 45 to limit radially outward movement of the latch ring 36. In the absence of this feature, a ring intended to move outward slightly from the supporting body could move appreciably outward of the body, and that part of the ring could then inadvertently get hung up on a component when the assembly is lowered in the well. The C-shaped ring 36 may have upper and lower annular protrusions 42 that may also be C-shaped, while the stops 44 on extension sleeve 31 and seal body 45 may similarly be annular shaped, but may be circular rather than C-shaped. Upper and lower protrusions 42 are fixed on the latch ring 36, and stops 44 are fixed on the extension sleeve 31 and the body 45, so that radially outward movement of C-ring 36 is positively limited. By containing the latch ring 36 while it is run in the well through the riser and one or more BOPs, the reliability of the system is substantially enhanced because the latch ring does not get "hung up" on a component as it is lowered into the wellhead to adversely affect its operability.

It is also desirable to limit connecting or locking ring 40 so that it does not move radially inward until positioned and actuated to connect to the casing hanger. As shown in FIG. 8, the ring 40 includes outward projecting upper and lower protrusions 62. The seal body including the sleeve 31 and supporting body 45 contain projecting upper and lower stops 64 which are engaged by the protrusions 62 on ring 40. The C-ring 40 is contained such that no portion of the ring may move radially outside the seal body, and is retained by the seal body to limit movement to the intended functional movement, and preventing any circumferential portion of either ring from getting hung up as it is lowered in the well.

As discussed above, upper and lower protrusions on each of the locking rings preferably have the general shape of the C-shaped ring. Substantially ring-shaped stop surfaces supported on the seal body are provided along substantially the length of each upper and lower protrusion, thereby contributing to high reliability when the C-ring is subsequently activated for connection to one of the wellhead and the casing hanger. The stops which are engaged by these protrusions may each have a substantially circular configuration, thereby providing a large contact area between the protrusions and the ring when manipulated from the run-in position to the actuated position.

In the preferred embodiment seal body 48 supports both one or more radially external seals 30 for sealing with an internal surface of the wellhead, and one or more internal seals 33 for sealing with the casing hanger. The seal 30 is a more difficult seal to reliably obtain, and seal 30 may be a combination of a plastic member or a soft metal, such as lead or tin, and one or more radially projecting fingers formed from steel. The seal 33 may be an o-ring carried on the seal body for sealing with the casing hanger. Other seals, such as annular or metal bumps 35 on the seal body, alternatively may be provided for sealing with the casing hanger.

Figure 9:
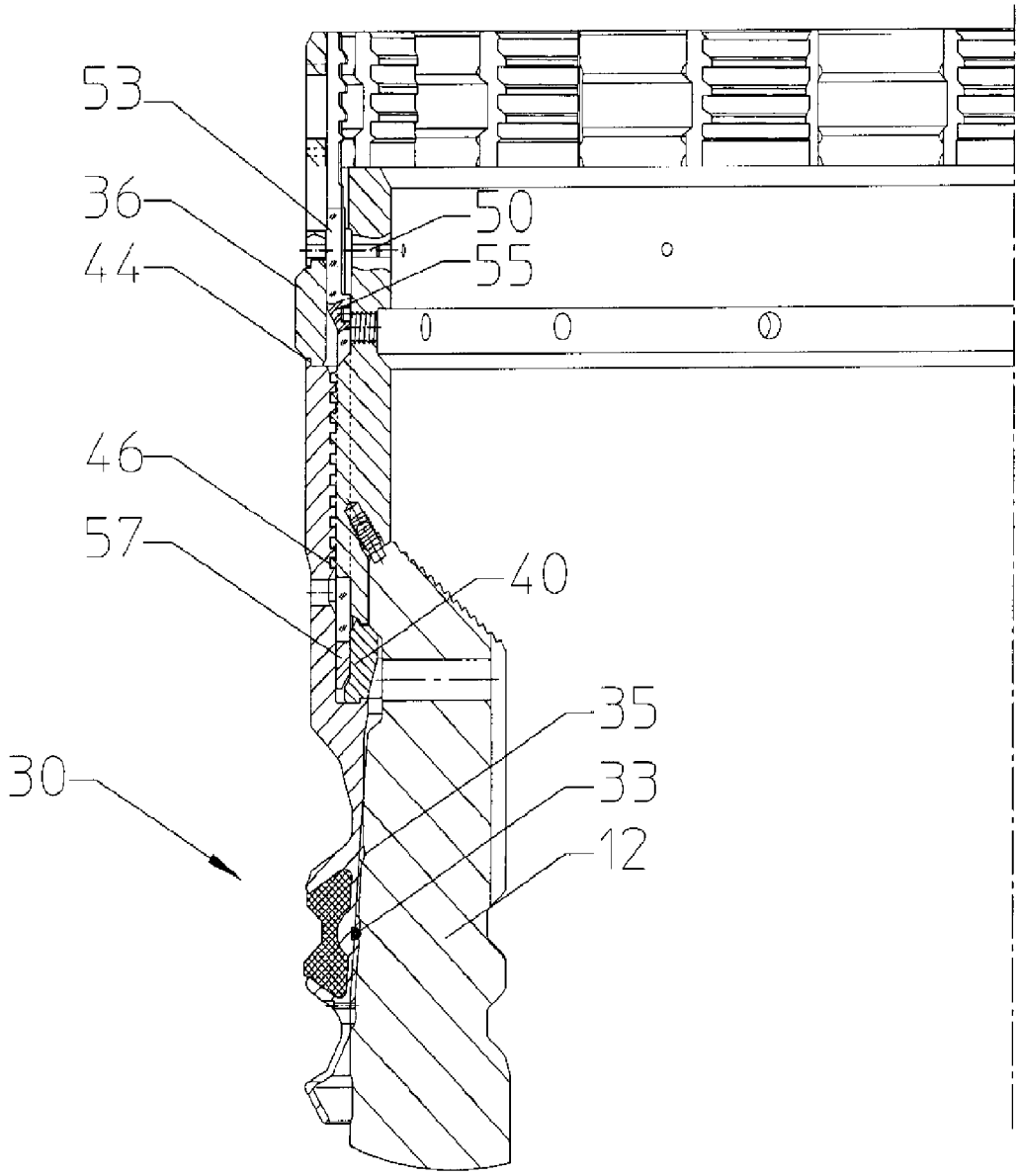
FIG. 9 is an enlarged view of the assembly shown in FIG. 8 with the seal assembly locked to the casing hanger and the latch ring positioned for latching to the wellhead.

FIG. 9 illustrates the shear pin 50 sheared, and the actuating sleeve 53 moved downward so that the latch ring 36 moves radially outward to fit within the corresponding groove in the wellhead, although still retained by stops 44. Retaining ring 40 has similarly moved radially inward so that it fits within its corresponding groove in the casing hanger 12. Lowering the sleeve 53 thus causes ramp surface 55 to engage and force the latch ring 36 radially outward, while the lower end 57 of the sleeve 53 has a tapered surface to move the ring 40 inward, then a cylindrical surface prevents the ring 40 from moving radially outward.

Figure 10:
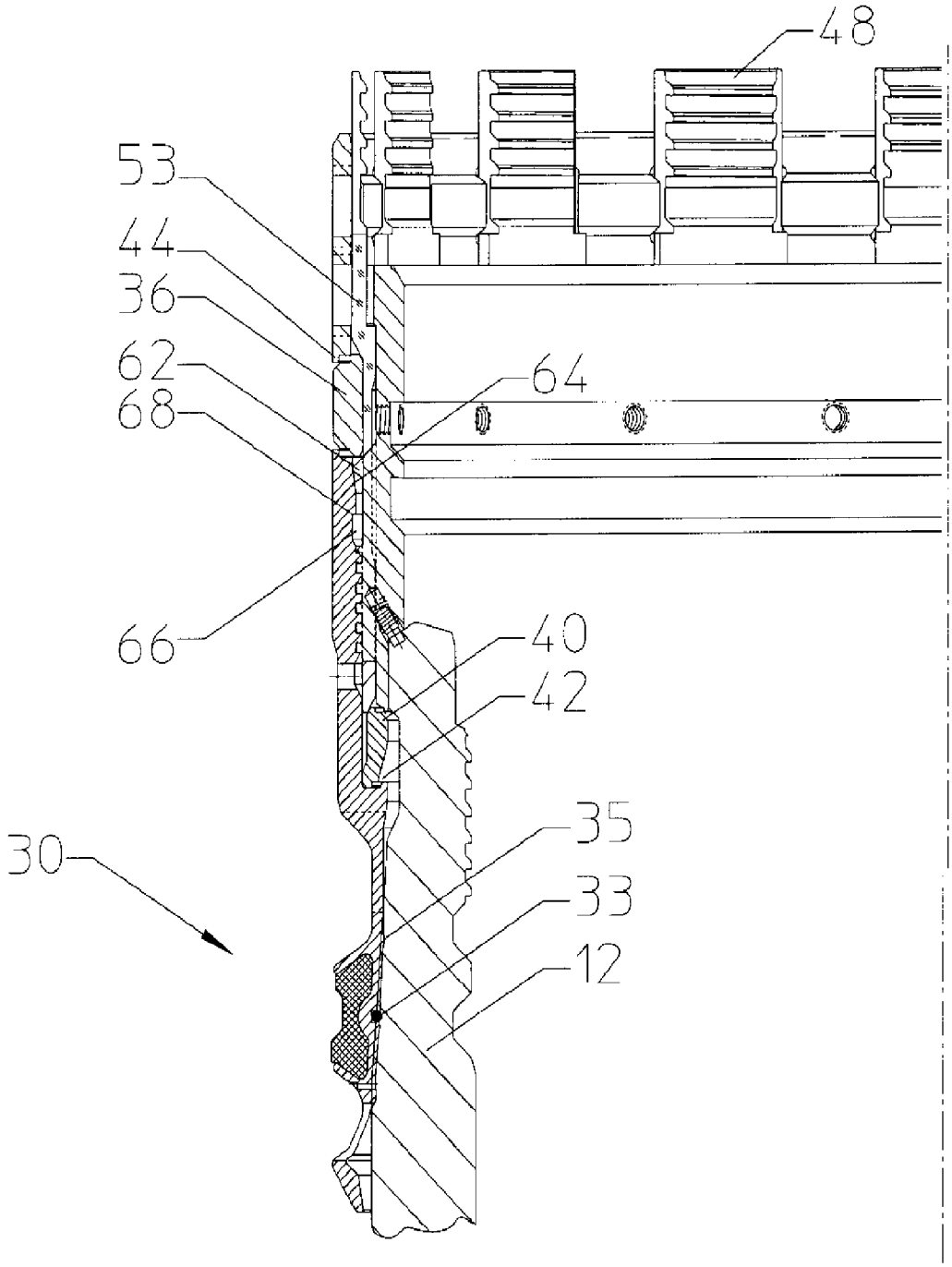
FIG. 10 is an enlarged view of an alternate seal assembly.
Figure 11:
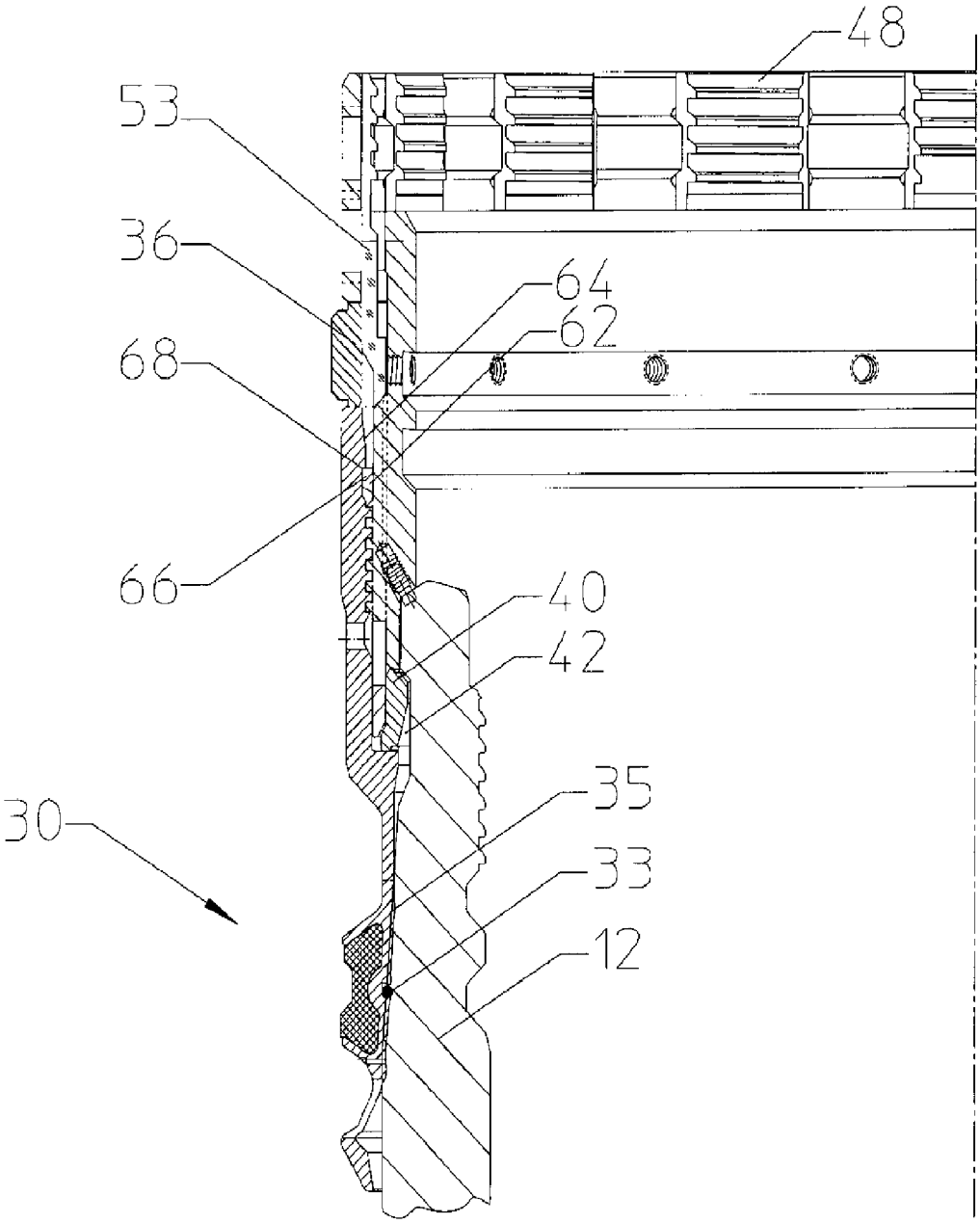
FIG. 11 is an enlarged view of the assembly shown in FIG. 10 locked to the casing hanger and the latch ring positioned for latching to the wellhead.

FIG. 10 depicts an alternative embodiment of the seal ring 30, with the lock ring 36 and the lock ring 40 as previously discussed. The ring 36 is retained by the seal assembly from prematurely moving radially outward, as with the embodiment discussed above, and the connecting ring 40 is similarly retained from moving radially inward. In the FIG. 10 embodiment, the actuating sleeve 53 includes a radially outward protrusion 62 that slides down ramp surface 64 and falls into annular groove 66 when the seal assembly is set, as shown in FIG. 11. The seal assembly may be secured to the wellhead by ring 36 and to the casing hanger by ring 40 promptly after the seal assembly is in its set position. Protrusion 62 and stop surface 68 on the seal assembly act as a positive stop to prevent upward movement of the seal body while set in the wellhead. In FIG. 11, the sleeve 53 is thus moved downward, releasing the latch ring 36 to move radially outward, releasing connecting ring 40 to move radially inward, and capturing the protrusion 64 in the groove 66. To retrieve the seal assembly, an upward force may be applied to the sleeve 53 from a retrieval tool which shears the protrusion 62, thereby allowing sleeve 53 to move upward and radially moving the rings 36 and 40 to a released position.

Each of the latch ring and the connecting ring as disclosed herein fit within a groove or recess in the wellhead and the casing hanger, respectively. Most of the discussion involves the use of a groove to receive the respective ring, and an annular groove is suitable for that purpose. In other cases, however, an annular groove may not be necessary, and one or more recesses may be provided in the wellhead and the casing hanger, respectively, to receive the latch ring or the connecting ring. The recesses may have an arcuate shape, or may be otherwise configured to reliably receive the respective ring.

Each of the locking members 36 and 40 as disclosed herein may be a substantially C-shaped locking ring which is retained on the seal body by the stops. C-shaped locking rings are preferred for many applications due to their high reliability, simplistic operation, and their ability to reliably withstand high loads. Other types of locking members may be used for axially interconnecting the seal body to either or both the wellhead and the casing hanger, including radially movable dogs which would fit within the corresponding recesses.

The method of sealing a casing in the wellhead should be apparent from the above description. The casing hanger is positioned within the wellhead, and the casing hanger preferably includes a radially external groove therein. A radially internal groove is provided in the wellhead. The method includes radially moving the latch ring, e.g., by actuating the running tool, to move sleeve 53 so that the locking ring 36 moves into the internal groove in the wellhead to axially connect the seal assembly and the wellhead. According to a preferred embodiment, the method includes radially moving another locking ring into an external groove in the casing hanger and to connect the seal assembly and the casing hanger. The running tool may set the latch ring and the connecting ring once the seal body is in its fully set position.

Each of the latch ring and the connecting ring is supported on the seal assembly in a manner which limits radial movement of the ring beyond the tool body. More particularly, the method includes providing stops on the seal body to prevent premature axial movement of either locking ring with respect to the seal body. A piston on the running tool is moveable in response to fluid pressure in the running tool, and may be used for actuating each locking ring 36 and 40 through the actuation sleeve.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A seal assembly for sealing a casing annulus in a subsea wellhead having a radially internal recess therein and a casing hanger positioned within the wellhead including a radially external recess therein, the seal assembly comprising:

a seal body supporting one or more radially internal seals and one or more radially external seals;

an actuation sleeve axially movable with respect to the subsea wellhead in response to a running tool;

a first locking member radially movable by the actuation sleeve to move into the internal recess in the wellhead to axially connect the seal body and the wellhead;

a second locking member radially movable by the actuation sleeve to move into the external recess in the casing hanger to axially connect the seal body and the casing hanger;

upper and lower stops supported on the seal body for engaging each of the first locking member and the second locking member to limit radial movement of the first and second locking members; and wherein the first locking member is a C-shaped locking ring supported on the seal body and radially movable outward to fit within the internal recess in the wellhead.

2. The seal assembly as defined in claim 1, wherein the second locking member is a C-shaped locking ring supported on the seal body and radially movable inward to fit within the external recess in the casing hanger.

3. The seal assembly as defined in claim 1, further comprising:

the upper stop and the lower stop engage respective upper and lower protrusions on the first locking member and the second locking member to limit radial movement of the first and second locking members.

4. The seal assembly as defined in claim 1, wherein the seal body comprises:

a radially inner seal body forming the upper first and second stops each for engaging a respective one of the first and second locking members; and a radially outer seal body supported on the inner seal body and forming the lower first and second stops each for engaging a respective one of the first and second locking members.

5. The seal assembly as defined in claim 4, wherein the radially inner seal body is threadably connected to the radially outer seal body.

6. The seal assembly as defined in claim 1, wherein the upper and lower stops of the seal body are each substantially ring-shaped stops secured to the seal body.

7. The seal assembly as defined in claim 6, wherein each upper and lower stop engages a substantially C-shaped protrusion on a respective one of the first and second locking members.

8. A seal assembly run in a well on a running tool for sealing a casing annulus in a subsea wellhead with a casing hanger positioned within the wellhead and having an external recess therein, the wellhead having a radially internal recess therein, the seal assembly comprising:

a seal body supporting one or more radially internal seals and one or more radially external seals;

an actuation sleeve axially movable with respect to the subsea wellhead in response to the running tool;

a first locking ring supported on the seal body and radially movable outward in response to movement of the actuation sleeve to move at least a portion of the first locking ring into the internal recess in the wellhead to axially connect the seal body and the wellhead;

a second locking ring supported on the seal body and radially movable inward and in response to movement of the actuation sleeve to move at least a portion of the second locking ring into the external recess in the casing hanger to axially connect the seal body and the casing hanger;

an upper stop and a lower stop supported on the seal body for engaging each of the first and second locking rings to limit radial movement of each of the first and second locking rings, and wherein the first locking ring is a C-shaped locking ring supported on the seal body and radially movable outward to fit within the internal recess in the wellhead.

9. The seal assembly and running tool as defined in claim 8, wherein the upper and lower stops on the seal body engage upper and lower protrusions on each of the first and second locking rings.

10. The seal assembly and running tool as defined in claim 8, wherein the running tool moves the actuation sleeve which activates both the first locking ring and the second locking ring.

11. The seal assembly and running tool as defined in claim 10, wherein the running tool includes a piston movable in response to fluid pressure in the running tool.

12. The seal assembly and running tool as defined in claim 8, wherein the running tool is released from the seal assembly by rotation of the running tool and shearing of one or more shear members.

13. The seal assembly and running tool as defined in claim 8, wherein the seal body comprises:

a radially inner seal body forming the upper first and second stops each for engaging a respective one of the first and second locking members; and a radially outer seal body supported on the inner seal body and forming the lower first and second stops each for engaging a respective one of the first and second locking members.

14. The seal assembly and running tool as defined in claim 13, wherein the radially inner seal body is threadably connected to the radially outer seal body.

15. The seal assembly and running tool as defined in claim 8, wherein the upper and lower stops of the seal body are each substantially ring-shaped stops secured to the seal body.

16. The seal assembly and running tool as defined in claim 15, wherein each upper and lower stop engages a substantially C-shaped protrusion on a respective one of the first and second locking members.

17. A method of sealing a casing hanger having a radially external recess to a wellhead having a radially internal recess, comprising:

providing a seal body having one or more seals;

radially moving a first locking member to move into the internal recess in the wellhead to axially connect the seal body and the wellhead;

radially moving a second locking member to move into the external recess in the casing hanger to connect the seal body and the casing hanger, such that the seal body seals the casing annulus while being interconnected with the wellhead and the casing hanger;

limiting radial movement of each of the first and second locking members by upper and lower stops supported on the seal body; and wherein the first locking member is a C-shaped locking ring supported on the seal body and radially moveable outward to fit within the internal recess in the wellhead.

18. The method as defined in claim 17, wherein each of the first and second locking members is activated during downward movement of an actuation sleeve.

19. The method as defined in claim 17, wherein each of the upper and lower stops is formed to have a substantially ring-shaped configuration.

* * * * *